US006003790A

United States Patent [19]

Fly

[11] Patent Number: 6,003,790

[45] Date of Patent: Dec. 21, 1999

[54] PRE-LOAD MECHANISM HAVING SELF-MOUNTING COIL SPRING

[75] Inventor: Ron G. Fly, Saline, Mich.

[73] Assignee: Ford Global Technologies, Inc., Dearborn, Mich.

[21] Appl. No.: 09/172,403

[22] Filed: Oct. 14, 1998

[51] Int. Cl.[6] ..... B05B 15/00

[52] U.S. Cl. ..... 239/533.9; 239/533.1; 239/585.4; 239/571; 239/569

[58] Field of Search ..... 239/533.1, 533.6, 239/533.9, 533.15, 585.1, 585.4, 569–571; 267/179

[56] References Cited

U.S. PATENT DOCUMENTS

| | | | |
|---|---|---|---|
| 2,991,064 | 7/1961 | De Jean . | |
| 3,250,477 | 5/1966 | Oster | 239/533.9 X |
| 4,549,859 | 10/1985 | Andrione et al. | 267/179 X |
| 4,669,429 | 6/1987 | Nishida et al. | 123/179 |
| 5,381,999 | 1/1995 | Ricco | 251/129.16 |
| 5,402,764 | 4/1995 | Rossignol et al. | 123/508 |
| 5,443,209 | 8/1995 | VanAllsburg | 239/90 |
| 5,494,224 | 2/1996 | Hall et al. | 239/585.5 |
| 5,494,225 | 2/1996 | Nally et al. | 239/585.5 |
| 5,615,870 | 4/1997 | Balsells | 267/167 |
| 5,655,716 | 8/1997 | Mathis | 239/533.8 |
| 5,803,052 | 9/1998 | Lorraine et al. | 123/470 |

*Primary Examiner*—Lesley D. Morris
*Attorney, Agent, or Firm*—Jerome R. Drouillard

[57] ABSTRACT

A pre-load mechanism has a self-mounting coil spring that resiliently forces a pre-loading member against a pre-loaded member. The spring has an active helical-coiled portion that is resiliently expandable and contractible in axial length to set the pre-load force and a mounting coil portion that has an interference fit with the mounting member for allowing the pre-load force to be set by forced positioning of the mounting coil portion on the mounting member to a calibrated position, and once the pre-load has been so set, for maintaining the mounting coil portion in the calibrated position as the active coil portion expands and contracts in axial length. The mounting coil portion has non-circular helical convolutions with protruding lobes that bear against the mounting member.

18 Claims, 2 Drawing Sheets

PRE-LOAD MECHANISM HAVING SELF-MOUNTING COIL SPRING

BACKGROUND OF THE INVENTION

1. Field of the Invention

This invention relates generally to pre-load mechanisms, and more particularly to a pre-load mechanism having a self-mounting coil spring that resiliently forces a pre-loading member against a pre-loaded member. The inventive principles are especially advantageous in electric-operated fuel injectors of the type used in internal combustion engines that power automotive vehicles, although it is believed that inventive principles may be utilized to advantage in various valves and in detent mechanisms.

2. Background Information

Each of U.S. Pat. Nos. 5,494,224 and 5,494,225 describes an electric-operated fuel injector for an internal combustion engine. The fuel injector has an armature/needle valve assembly that, in closed condition of the fuel injector, is resiliently biased by a helical coil pre-load spring to cause a tip end of the needle valve to forcefully seat against a valve seat member in closure of a through-hole at the center of the valve seat member. The fuel injector also has an electromagnet coil that, when energized by an electric control circuit to which it is connected, operates the fuel injector to open condition. The electromagnetic force acts on the armature to overcome the pre-load force and unseat the tip end of the needle valve from the valve seat member, thereby opening the through-hole in the valve seat member so that pressurized liquid fuel can be injected into the engine from a nozzle end of the fuel injector.

Calibration of the fuel injector comprises setting axial compression of the pre-load spring in an amount that results in the exertion of a certain axial pre-load force on the valve seat member by the seated tip of the needle valve when the electromagnet coil is not being energized.

The fuel injector further comprises a fuel inlet tube through which fuel passes axially from an inlet end into the interior of the fuel injector. One axial end of the pre-load spring is disposed within a lower axial end of the fuel inlet tube; the opposite axial end of the spring is received within a counterbore in one axial end of the armature, bearing against an internal shoulder at an internal end of the counterbore. In a calibrated fuel injector, the one axial end of the spring that is disposed within the lower end of the fuel inlet tube bears axially against an axial end of an adjustment tube which is telescopically received within, and joined with, the fuel inlet tube, and which serves to convey fuel along that portion of the length of the fuel inlet tube with which it is axially coextensive.

The calibration process comprises axially positioning the adjustment tube relative to the fuel inlet tube, before the two tubes are joined together, to set the axial compression of the pre-load spring in an amount that results in the exertion of a certain axial pre-load force on the valve seat member by the seated tip of the needle valve. Then the two tubes are joined, such as by mechanically staking, or crimping, one to the other.

Calibration may, for example, be performed at a station of an automated fuel injector processing line where a fuel injector is operated to open condition and liquid is flowed through it. A servo-motor-controlled actuator at the station positions the adjustment tube axially within the fuel inlet tube, compressing the pre-load spring in the process, as liquid flow through the open fuel injector is measured. When a desired flow is achieved, the two tubes are axially locked together by crimping the outside diameter (O.D.) of the fuel inlet tube such that its inside diameter (I.D.) deforms sufficiently onto the O.D. of the adjustment tube to prevent relative axial movement between the two tubes without impeding flow through the adjustment tube.

It is believed that this crimping step may at times cause an unintended component of relative axial movement between the two tubes that affects the intended calibration. Accordingly, replacement of this crimping step by a different step that would eliminate the possibility of accompanying, unintended, relative axial movement between a fuel inlet tube and an adjustment tube is seen to be desirable.

It has heretofore been proposed to employ a roll pin in place of an adjustment tube. The roll pin is increasingly pressed, with a press-fit, into the fuel inlet tube by a mandrel until the intended calibration is attained. While this process eliminates the crimping step, it is not reversible. Hence, it is believed that extensive care must be taken in order to avoid the occurrence of irreversible axial overtravel when pressing a roll pin into a fuel inlet tube. Lack of adequate control may produce excessive axial overtravel of a roll pin that results in scrapping of in-process parts.

SUMMARY OF THE INVENTION

One aspect of the present invention relates to a fuel injector having a self-mounting, helical pre-load spring that enables pre-load calibration of a fuel injector to be performed in novel way because of the relationship of certain constructional features of the pre-load spring with other parts of the fuel injector. The inventive principles offer the advantage of eliminating the aforementioned adjustment tube or roll pin. The self-mounting spring comprises two axial sections: an active section and a mounting section. The mounting section is fit to the I.D. of the fuel inlet tube with an interference fit that joins the spring and the fuel inlet tube in a manner that allows relative movement to set desired calibration, but thereafter prevents relative axial movement and hence maintains the set calibration.

Another, more comprehensive, aspect of the invention relates to a pre-load mechanism comprising a pre-loading member, a pre-loaded member, a mounting member, and a pre-load spring which is kinematically disposed between the mounting member and the pre-loading member to resiliently transmit pre-load force through the pre-loading member to the pre-loaded member while the pre-load force is reacted at a mounting of the spring on the mounting member, the pre-load spring comprising an active coil portion, comprising plural, active, helical-coiled convolutions, that is resiliently expandable and contractible in axial length to set the pre-load force and a mounting coil portion, comprising plural mounting coil convolutions, that has an interference fit with the mounting member for allowing the pre-load force to be set by forced positioning of the mounting coil portion on the mounting member to a calibrated position, and once the pre-load has been so set, for maintaining the mounting coil portion in the calibrated position as the active coil portion expands and contracts in axial length.

Another general aspect relates to a method of setting pre-load force in a pre-load mechanism that has a pre-loading member, a pre-loaded member, a mounting member, and a pre-load spring which is kinematically disposed between the mounting member and the pre-loading member to resiliently transmit pre-load force through the pre-loading member to the pre-loaded member while the pre-load force is reacted at a mounting of the spring on the mounting member, the pre-load spring comprising an active coil portion, comprising plural, active, helical-coiled convolutions, that is resiliently expandable and contractible in axial length to set the pre-load force and a mounting coil portion, comprising plural mounting coil convolutions that have interference fits with the mounting member, the method comprising setting the pre-load force by forced positioning of the mounting coil convolutions relative to the mounting member while the mounting coil convolutions remain interference fitted with the mounting member.

More specific aspects of the invention, including the application of its principles to fuel injectors, detent mechanisms, and relief valves, will been set forth in the ensuing description and claims.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT

Figures 1, 10:
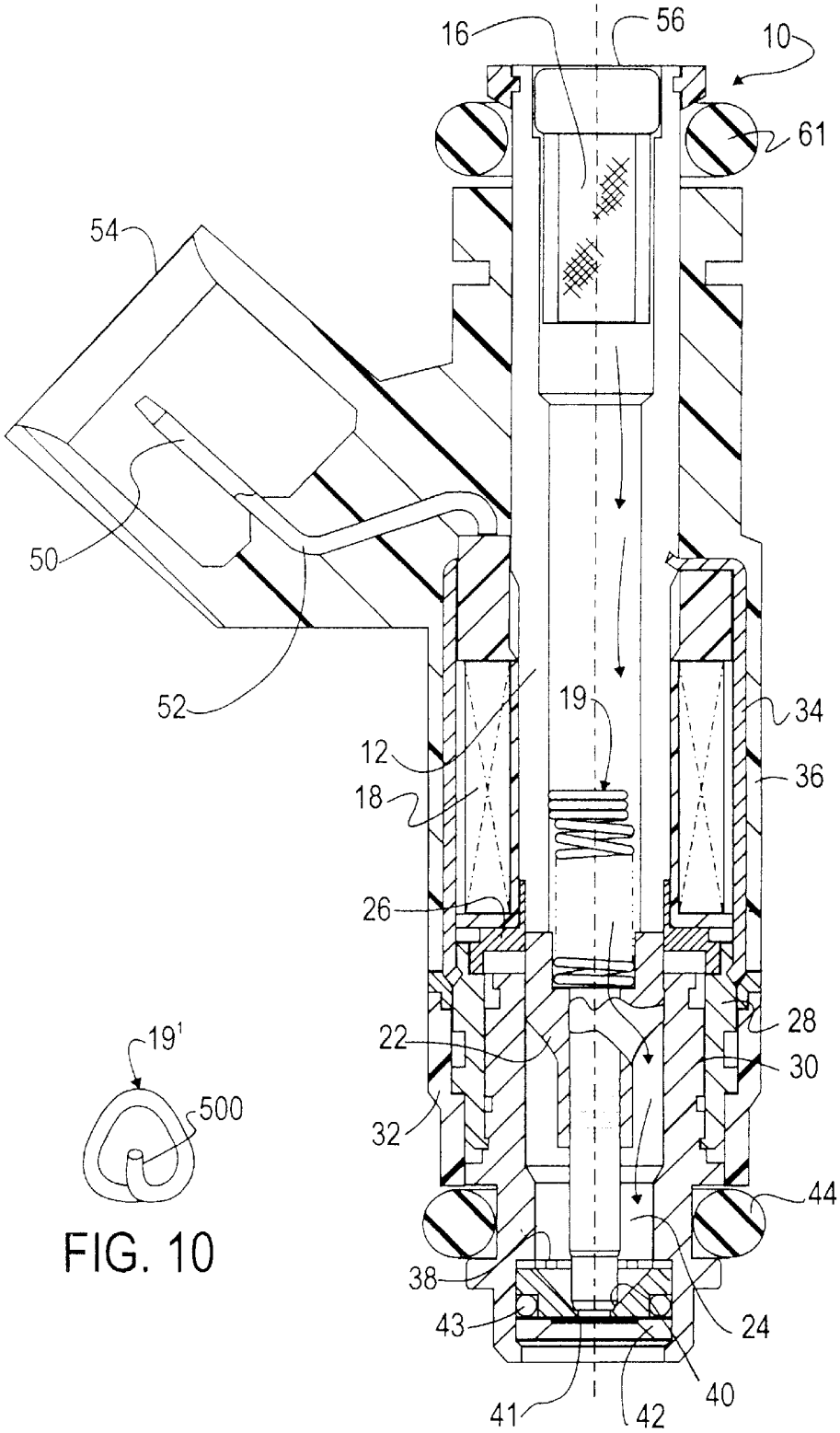
FIG. 1 is a longitudinal cross section view of a fuel injector embodying principles of the present invention.
FIG. 10 is an axial end view of a pre-load spring that includes a tail at one end.
Figure 3:
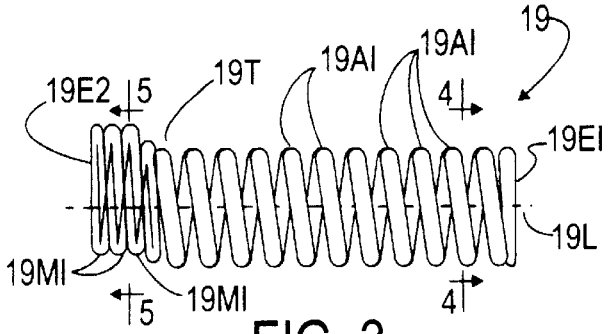
FIG. 3 is a longitudinal view of the pre-load spring of FIG. 2.

FIG. 1 shows a representative fuel injector 10 embodying principles of the present invention. Fuel injector 10 is similar to the one described in each of U.S. Pat. Nos. 5,494,224 and 5,494,225, which are incorporated in their entirety herein by reference. Fuel injector 10 differs however in that instead of an individual adjustment tube and an individual coil spring, it comprises a self-mounting coil spring 19 for pre-loading the armature/needle valve assembly.

Hence, like the fuel injectors of the referenced patents, fuel injector 10 comprises: a fuel inlet tube 12, a filter assembly 16, an electromagnet coil assembly 18, an armature 22, a needle valve 24, a non-magnetic shell 26, a valve body shell 28, a valve body 30, a plastic shell 32, a coil assembly housing 34, a non-metallic, over-mold cover 36, a needle guide member 38, a valve seat member 40, a thin disk orifice member 41, a back-up retainer member 42, three O-ring seals 43, 44, and 61. Armature 22 and needle valve 24 are joined to form an armature/needle valve assembly.

Fuel injector 10 further comprises an electric connector 54 containing electric terminals 50, 52 for mating connection with respective terminals of a connector of a wiring harness (not shown) leading to an electric control circuit for energizing coil assembly 18. Because fuel injector in 10 lacks an adjustment tube, filter assembly 16 mounts on fuel inlet tube 12 just interior of a fuel inlet opening 56 where liquid fuel under pressure is introduced into fuel injector 10.

Coil spring 19 has a central longitudinal axis 19L and may be considered to comprise two axial sections: an active coil section 19A and a mounting coil section 19M. Mounting coil section 19M is fit to the I.D. of fuel inlet tube 12 with an interference fit that associates spring 19 with tube 12 in a manner that allows relative axial movement to accomplish calibration, but thereafter prevents relative axial movement so that the set calibration is maintained during operation of the fuel injector.

FIG. 1 shows a closed condition of fuel injector 10 where coil assembly 18 is not being energized. In such closed condition, active coil section 19A is exerting a calibrated pre-load force on armature/needle valve assembly 22, 24 to cause the rounded tip end of needle valve 24 to forcefully seat on valve seat member 40 in closure of a through-hole at the center of member 40. Energizing coil assembly 18 operates fuel injector 10 to an open condition, with armature 22 being displaced upward against the spring pre-load force to unseat needle valve 24 from seat member 40. The upward armature/needle valve motion is taken up by increased axial compression of active spring section 19A.

In the open condition, fuel entering through opening 56 at one axial end of fuel injector 10 is filtered by filter assembly 16 and then passes internally along a path indicated by the arrows in FIG. 1 to an injection nozzle at the opposite axial end. The arrows show that fuel flows along the length of tube 12 to enter armature 22, then passes through a hole in armature 22 into enter a space bounded by valve body 30, then through that space, and holes in needle guide member 38, to the center of valve seat member 40 where it passes through member 40, finally to be injected out of the nozzle end and into an engine (not shown).

Fuel injector 10 returns to closed condition when energization of coil assembly 18 ceases. At that time, the force of active coil section 19A re-seats the tip of needle valve 24 closed on seat member 40 to terminate the fuel injection.

FIGS. 2–5 illustrate detail of spring 19, the spring being shown in free condition. Active coil section 19A comprises a number of essentially identical convolutions 19A1 arranged as a circular helix with respect to axis 19L and terminates in a closed end 19E1 that is ground flat substantially perpendicular to axis 19L. Mounting coil section 19M comprises a number of essentially identical convolutions 19M1, arranged as a non-circular helix with respect to axis 19L, and terminates in a closed end 19E2. The two sections 19A, 19M merge with each other along a short transition section 19T.

Figure 5:
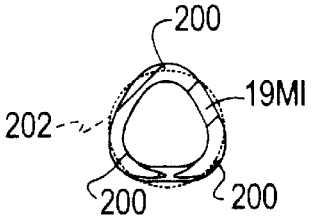
FIG. 5 is a transverse cross section view in the direction of arrows 5—5 in FIG. 3.
Figure 2:
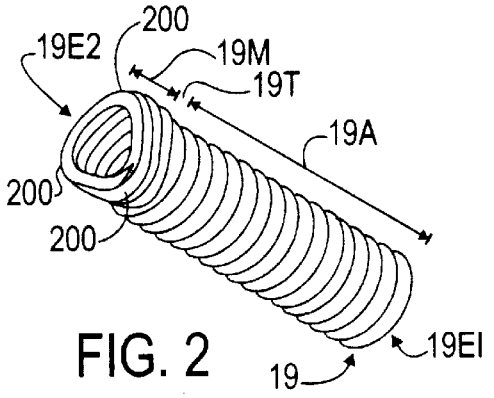
FIG. 2 is a perspective view of one part of the fuel injector, namely a self-mounting pre-load spring, by itself in free condition.
Figure 4:
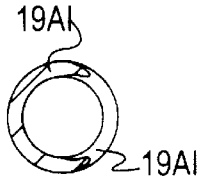
FIG. 4 is a transverse cross section view in the direction of arrows 4—4 in FIG. 3.

FIG. 5 shows that convolutions 19M1 are shaped to provide a succession of radially outward directed lobes 200 that provide the interference fit with the mounting member. An imaginary circle 202 describes the I.D. of fuel inlet tube 12 to show interference that lobes 200 have with the fuel inlet tube I.D. prior to mounting of spring 19 on tube 12. This view is intended to illustrate the presence of such interference and is not to be construed as necessarily to scale. As coil section 19M is being pressed into tube 12, convolutions 19M1 deform from the free shape shown in FIG. 4 to a contracted shape where the crowns of lobes 200 assume tangency with the fuel inlet tube I.D. Segments of the convolutions between the lobes are generally straight as viewed along axis 19L and out of contact with the tube wall. The resiliency of the spring material causes lobes 200 to exert radially outwardly directed forces against the tube I.D. These forces are collectively sufficiently large that once mounting section 19M has been pressed to a position within tube 12, section 19M maintains itself axially fixed in that position. Because spring 19 is pressed into tube 12 to a final position that causes spring section 19A to create pre-load force, the forces exerted by lobes 200 on the tube I.D. must be sufficiently large to create an axial force for holding coil section 19M in final position that is greater than the pre-load force plus any additional forces that, during use, may attempt to move section 19M relative to tube 12. In the illustrated embodiment, the crowns of lobes 200 are centered at 120° circumferential intervals about axis 19L, and the lobes of three convolutions 19M1 bear against the I.D. of tube 12. It is believed that such a tri-lobe construction for each convolution 19M1 is especially desirable for various reasons relating to fabrication and functionality.

Spring 19 can be fabricated by known spring forming technology. Although the tri-lobe shapes of convolutions 19M1 are generally helical, although not circular, they can formed by programming known CNC multi-slide coil forming machinery using known techniques.

The integration of the pre-load and the adjustably positionable mounting functions in a single part is believed to afford certain functional improvements in comparison to a separate pre-load spring that is compressed by axially positioning either a separate adjustment tube or a separate roll pin within an outer tube. The integration inherently centers the active coil portion within the outer tube, thereby avoiding the possibility of radial and/or circumferential float that a separate pre-load spring might experience in a mechanism that utilizes a separate adjustment tube or roll pin. Because it is self-centering, the spring does not necessarily require a centering feature in the armature. The armature may be left free, within parts dimensions and tolerances, to find an optimum location for force equilibrium that will minimize, or ideally eliminate, spring-induced lateral force components. It is also believed that the tri-lobe configuration for convolutions 19M1 is especially helpful in accomplishing spring self-centering.

For a fuel injector having a given diameter of fuel inlet tube, the presence of either an adjustment tube or a roll pin necessarily restricts the fuel flow path through the fuel inlet tube. No adjustment tube or roll pin however is present in a fuel injector embodying principles of the present invention.

Given the foregoing description, it can be appreciated that fuel inlet tube 12 may be considered a mounting member, armature/needle valve member 22, 24 considered a pre-loading member, and seat member 40 a pre-loaded member. In that context, spring 19 is kinematically disposed between the mounting member and the pre-loading member to resiliently transmit pre-load force through the pre-loading member to the pre-loaded member while the pre-load force is reacted at a mounting of the spring on the mounting member. Active coil portion 19A is resiliently expandable and contractible in axial length to set the pre-load force and mounting coil portion 19M has an interference fit with the mounting member for allowing the pre-load force to be set by forced axial positioning of mounting coil portion 19M on the mounting member to a calibrated position, and once the pre-load has been so set, for maintaining mounting coil portion 19M in the calibrated position as active coil portion 19A expands and contracts in axial length.

Figure 6:
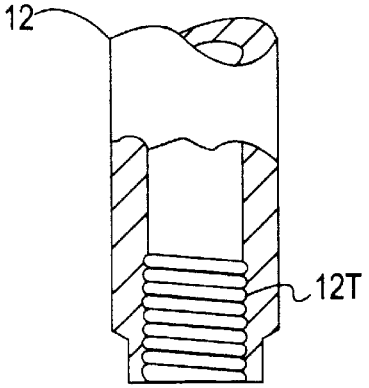
FIG. 6 is a fragmentary view, partly in cross section, of a part of a fuel injector shown by itself as one example of a specific feature for accepting the spring of FIG. 2.
Figure 7:
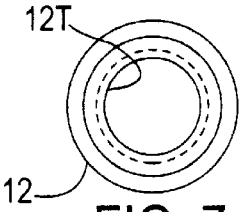
FIG. 7 is a bottom end view of FIG. 6.

FIGS. 6 and 7 disclose an inlet tube 12 that has an internal feature 12T, a helical thread for example, proximate to its inner axial end. The thread pitch substantially matches that described by the crowns of the lobes 200 of a spring mounting section 19M containing tightly wound tri-lobe convolutions 19M1 when the spring mounting section is contracted from its free condition by threading it into thread 12T. For a spring that is fabricated from circular wire, like the one illustrated in FIGS. 1–5, thread 12T is profiled to be slightly less than semi-circular and substantially match an arc described by the wire diameter. By twisting mounting section 19M relative to tube 12, the action between the crowns of lobes 200 and thread 12T axially positions the spring to set the desired pre-load. The collective outwardly directed force of lobes 200 of the contracted convolutions 19M1 against the inlet tube is sufficiently great to hold the spring in calibrated position once the pre-load has been set. Because it is possible to advance spring mounting section 19M by twisting in one sense and to retract the mounting section by twisting in the opposite sense, the final increment of twisting that achieves desired calibration can occur in either sense. Such a capability is seen to be a meaningful improvement over other fuel injectors described above. As explained above, calibration of fuel injectors that have either adjustment tubes or roll pins can be performed solely by advancement of an adjustment tube or a roll pin within a fuel inlet tube, and the inherent natures of those methods preclude the ability to accomplish suitable calibration by retracting either tube or pin after advancement.

Figure 8:
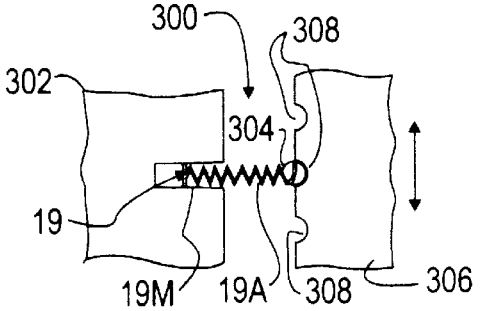
FIG. 8 shows an example of a detent mechanism embodying certain principles of the invention.

FIG. 8 shows a detent mechanism 300 that comprises a mounting member 302, a pre-loading member 304, and a pre-loaded member 306. Spring 19 is kinematically disposed between mounting member 302 and pre-loading member 304 to resiliently transmit pre-load force through member 304 to member 306 while the pre-load force is reacted at the mounting of spring 19 on mounting member 302. Member 306 is movable in opposite senses indicated by the double headed arrow and contains one or more notches 308 along a surface that confronts pre-loading member 304. For example, FIG. 8 shows member 304 seating in a notch 308, the notches 308 being circularly contoured and member 304 being a sphere. As member 306 moves from the position shown, camming action of the notch on the sphere dislodges the sphere from the notch, further compressing the active portion of the spring in the process. When member 306 moves to once again register a notch 306 with sphere 304, the spring re-seats the sphere in the registering notch. Although FIG. 8 depicts member 306 as linearly movable, such movement could be arcuate.

Figure 9:
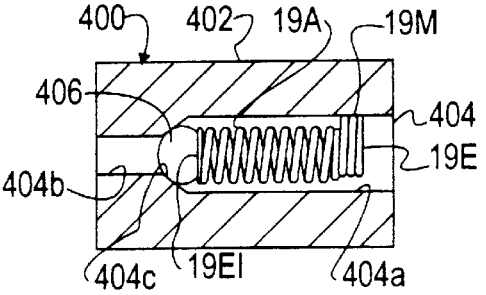
FIG. 9 is a cross section view showing an example of a relief valve embodying the inventive principles.

FIG. 9 discloses a relief valve 400 containing a spring 19. Relief valve 400 comprises a body 402 having a bore 404. One end of bore 404 comprises a larger diameter circular cylindrical wall 404*a*, and the opposite end comprises a smaller diameter circular cylindrical wall 404*b*. An axially intermediate frusto-conical wall 404*c* joins walls 404*a* and 404*b*. A movable valve member 406 mounts coaxially to spring end 19E1. One example of valve member 406 is shown in the Figure as a sphere seated coaxially in spring end 19E1. Sphere 406 and spring 19 are disposed within bore 404 such that mounting coil section 19M is fit to wall 404*a* to mount the spring on the valve body, and such that active coil section 19A is resiliently pre-loading sphere 406 to seat against wall 404*c* with a desired pre-load force in closure of bore 404. The force is established by the spring characteristics of active coil section 19A and the axial position along wall 404*a* to which mounting coil section 19M has been fit. The valve inlet is at the open end of wall 404*b*, and the valve outlet at the open end of wall 404*a*. Creation of a fluid pressure differential between inlet and outlet imposes additional axial force on the seated sphere. When the inlet pressure exceeds the outlet pressure by an amount that creates a force that is opposite and begins to exceed the spring force, sphere 404 begins to unseat from surface 404*c*, thereby initiating valve opening. The valve will remain open until the inlet-outlet pressure differential once again drops below that at which the sphere began to unseat.

FIG. 10 displays a spring 19' that is identical to spring 19 except for having a tail 500 at end 19E2. Tail 500 is an end segment of the wire that forms the spring. One example of a configuration for tail 500 comprises the tail extending radially inward from mounting section 19M in the direction of opening 56. The inclusion of a tail 500 may be useful from the standpoints of both fuel injector fabrication and fuel injector performance.

The presence of a fuel vapor bubble, or bubbles, internally of a fuel injector may obstruct fuel flow through an injector. The presence of a tail 500 in the fuel flow path may however beneficially discourage the formation of vapor bubbles and/or aid in their elimination. Because its opposite axial ends are different in both spring 19 and in spring 19', it becomes possible for reverse assembly of such a spring into a fuel injector to be detected and corrected while the fuel injector is still in the process of manufacture.

In conclusion, it is believed that the foregoing description of exemplary embodiments of the present invention has revealed a number of favorable attributes relating to fabrication and use of pre-load mechanisms and to the application of such mechanisms to various devices including valves and detents. It is also to be appreciated that the invention may be practiced in various forms within the scope of the following claims. For example, if lobes 200 were directed radially inward, the spring could self-mount on an outside diameter of a mounting member. The manner of mounting a spring may comprise either axially pressing the spring or twisting it.

I claim:

1. A pre-load mechanism comprising a pre-loading member, a pre-loaded member, a mounting member, and a pre-load spring which is kinematically disposed between the mounting member and the pre-loading member to resiliently transmit pre-load force through the pre-loading member to the pre-loaded member while the pre-load force is reacted at a mounting of the spring on the mounting member, the pre-load spring comprising an active coil portion, comprising plural active coil convolutions, that is resiliently expandable and contractible in axial length to set the pre-load force and a mounting coil portion, comprising plural mounting coil convolutions, that has an interference fit with the mounting member for allowing the pre-load force to be set by forced positioning of the mounting coil portion on the mounting member to a calibrated position, and once the pre-load has been so set, for maintaining the mounting coil portion in the calibrated position as the active coil portion expands and contracts in axial length.

2. A pre-load mechanism as set forth in claim 1 in which the mounting coil convolutions comprise a succession of radially directed lobes that provide the interference fit with the mounting member.

3. A pre-load mechanism as set forth in claim 2 in which the mounting member comprises a circular hole with which the succession of lobes are in interference fit, and the succession of lobes comprises a succession of radially outwardly directed lobes centered at 120° circumferential intervals.

4. A pre-load mechanism as set forth in claim 3 in which the mounting member comprises a tube forming a portion of a fluid passage through a valve, the pre-loaded member comprises a valve seat member, and the pre-loading member comprises a valve member that seats on the valve seat member to close the fluid passage and that unseats from the valve seat member to open the flow passage.

5. A pre-load mechanism as set forth in claim 1 in which the mounting member comprises a cylindrical surface with which the mounting coil portion has interference fit.

6. A pre-load mechanism as set forth in claim 1 in which the mounting member comprises a helical threaded surface with which the mounting coil portion has interference fit.

7. A method of setting pre-load force of a pre-load mechanism that comprises a pre-loading member, a pre-loaded member, a mounting member, and a pre-load spring which is kinematically disposed between the mounting member and the pre-loading member to resiliently transmit pre-load force through the pre-loading member to the pre-loaded member while the pre-load force is reacted at a mounting of the spring on the mounting member, the pre-load spring comprising an active coil portion, comprising plural active coil convolutions, that is resiliently expandable and contractible in axial length to set the pre-load force and a mounting coil portion, comprising plural mounting coil convolutions, that is contracted from free condition into forceful interference fit with the mounting member, the method comprising: setting the pre-load force by forced positioning of the mounting coil portion on the mounting member to a calibrated position while the mounting coil portion maintains forceful interference fit with the mounting member.

8. A method as set forth in claim 7 in which the forced positioning step comprises applying axial force to slide the mounting coil portion axially on the mounting member.

9. A method as set forth in claim 7 in which the forced positioning step comprises applying twisting force to twist the mounting coil portion on a helical thread of the mounting member.

10. A fuel injector comprising a fuel inlet, a fuel outlet, a fuel flow path, including a fuel tube, between the inlet and outlet, an electric-operated valve mechanism for opening and closing the flow path, the valve mechanism comprising a valve member that is pre-loaded by a spring against a valve seat, and in which the spring comprises an active coil portion, comprising plural active coil convolutions, that is resiliently expandable and contractible in axial length to set the pre-load and a mounting coil portion, comprising plural mounting coil convolutions, that has an interference fit with the fuel tube for allowing the pre-load to be set by forced positioning of the mounting coil portion on the fuel tube, and once the pre-load has been so set, for holding the mounting coil portion against axial movement on the fuel tube as the active coil portion expands and contracts in axial length.

11. A fuel injector as set forth in claim 10 in which the mounting coil convolutions comprise a succession of radially directed lobes that provide the interference fit with the fuel tube.

12. A fuel injector as set forth in claim 11 in which the fuel tube comprises a circular hole with which the succession of lobes are in interference fit, and the succession of lobes comprises a succession of radially outwardly directed lobes centered at 120° circumferential intervals.

13. A fuel injector as set forth in claim 12 in which the circular hole has a smooth circular cylindrical surface with which the succession of lobes are in interference fit.

14. A fuel injector as set forth in claim 12 in which the circular hole has a helical thread with which the succession of lobes are in interference fit.

15. A detent mechanism comprising a pre-loading member, a pre-loaded member, a mounting member, and a pre-load spring which is kinematically disposed between the mounting member and the pre-loading member to resiliently transmit pre-load force through the pre-loading member to the pre-loaded member while the pre-load force is reacted at a mounting of the spring on the mounting member, the pre-load spring comprising an active coil portion, comprising plural active coil convolutions, that is resiliently expandable and contractible in axial length to set the pre-load force and a mounting coil portion, comprising plural mounting coil convolutions, that has an interference fit with the mounting member and holds the mounting coil portion on the mounting member as the active coil portion expands and contracts in axial length.

16. A detent mechanism as set forth in claim 15 in which the mounting coil convolutions comprise a succession of radially directed lobes that provide the interference fit with the mounting member.

17. A detent mechanism as set forth in claim 16 in which the mounting member comprises a circular hole with which the succession of lobes are in interference fit, and the succession of lobes comprises a succession of radially outwardly directed lobes centered at 120° circumferential intervals.

18. A relief valve comprising a valve body having a flow path, including a bore, extending between an inlet and an outlet, a seat surface circumscribing the bore, a valve member that is movable within the bore relative to the seat surface, a spring resiliently forcing the valve member in a sense toward the inlet to seat on the seat surface, the spring comprising an active coil portion, comprising plural active coil convolutions, that is resiliently expandable and contractible in axial length to set the force acting on the valve member and a mounting coil portion, comprising plural mounting coil convolutions, that has an interference fit with the bore for allowing the spring force acting on the valve member to be set by forced positioning of the mounting coil portion within the bore, and once that force has been so set, for maintaining the position of the mounting coil portion in the bore as the active coil portion expands and contracts in axial length.

* * * * *